US005584264A

United States Patent [19]

Moyer

[11] Patent Number: 5,584,264

[45] Date of Patent: Dec. 17, 1996

[54] METHOD AND APPARATUS FOR SMELT SPOUT CASTING INSTALLATION

[75] Inventor: Scott C. Moyer, Talladega, Ala.

[73] Assignee: The Babcock & Wilcox Company, New Orleans, La.

[21] Appl. No.: 556,444

[22] Filed: Nov. 9, 1995

[51] Int. Cl.[6] ..... F22B 15/00

[52] U.S. Cl. ..... 122/235.11; 29/890.037; 52/574

[58] Field of Search ..... 122/235.11; 29/890.051, 29/890.031; 52/514

[56] References Cited

U.S. PATENT DOCUMENTS 5,033,949 7/1991 Jewett ..... 52/514

*Primary Examiner*—Noah P. Kamen

*Attorney, Agent, or Firm*—Robert J. Edwards; D. Neil LaHaye

[57] ABSTRACT

An installation jig and method for installing the spout casting that eliminates the need for using a thick layer of refractory as previously done. The installation jig is formed from a threaded rod with a rectangular plate transversely fixed to one end of the rod and a second shorter, rectangular plate received on the rod at a distance from the fixed plate. A locking collar is received on the rod adjacent the shorter plate on the side remote from the fixed plate. The larger fixed plate is inserted into the boiler from the outside and is caused to bear against the tube surface. The smaller plate and locking collar are used to hold the casting in place until the casting is fixed in position by the installation of the spout.

1 Claim, 1 Drawing Sheet

METHOD AND APPARATUS FOR SMELT SPOUT CASTING INSTALLATION

BACKGROUND OF THE INVENTION

1. Field of the Invention

The invention is generally related to recovery boilers and more particularly to the installation of smelt spout castings therein.

2. General Background

Recovery boilers are used primarily to reclaim chemicals for reuse and to generate steam. The chemicals are reclaimed as a molten salt or smelt through openings between wall tubes in the boiler. A smelt spout is installed at each opening to allow the chemicals collecting on the floor to flow out and be collected via the spout. Due to the high temperatures involved and the corrosive nature of the chemicals being reclaimed, it becomes necessary to periodically replace the smelt spouts on the boilers. In recent years, a nozzle-shaped spout casting has been positioned between the spout and the wall tubes. The casting is designed to protect the wall tubes and smelt spouts from wear and forms a seal between the spout and the tubes. During installation of the spout casting and the spout, the spout casting has typically been held in place by a thick layer of refractory material until the spout could be installed. The spout is bolted to the wall of the boiler. The spout bears against the casting and then holds the casting in place. With this method of installation, the casting could easily be dislodged while the spout was being mounted. Also, the thick layer of refractory needed to adhere to the casting was prone to being burned away or to crumbling and thus leading to severe casting erosion. This leaves a need for a more efficient apparatus and method of installing the casting and holding it in place until the spout can be installed and bolted to the wall of the furnace.

SUMMARY OF THE INVENTION

The invention addresses the above need. What is provided is an installation jig and method for installing the spout casting that eliminates the need for using a thick layer of refractory as previously done. The installation jig is formed from a threaded rod with a rectangular plate transversely fixed to one end of the rod and a second shorter, rectangular plate is installed on the rod at a distance from the fixed plate. A locking collar is threadably received on the rod adjacent the smaller plate on the side remote from the fixed plate. The larger fixed plate is inserted into the boiler from the outside and is caused to bear against the tube surface. The smaller plate and locking collar are used to hold the casting in place until the casting is fixed in position by the installation of the spout.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
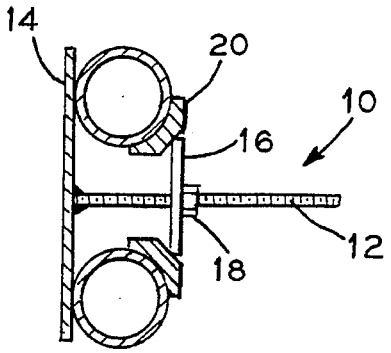
FIG. 1 is a top view that illustrates the invention in use.

Referring to the drawings, it is seen in FIG. 1 that the invention is generally indicated by the numeral 10. Casting installation jig 10 is comprised of threaded rod 12, first rectangular plate 14, second rectangular plate 16, and locking collar 18.

First rectangular plate 14 is transversely fixed to one end of threaded rod 12 at the center of first rectangular plate 14. Second rectangular plate 16 is shorter than first rectangular plate 14 and is provided with a bore at its center such that second rectangular plate 16 may be received on rod 12. Locking collar 18 may be formed from a threaded nut sized to be received on rod 12 adjacent second plate 16 on the side of second plate 16 remote from first plate 14.

Figure 2:
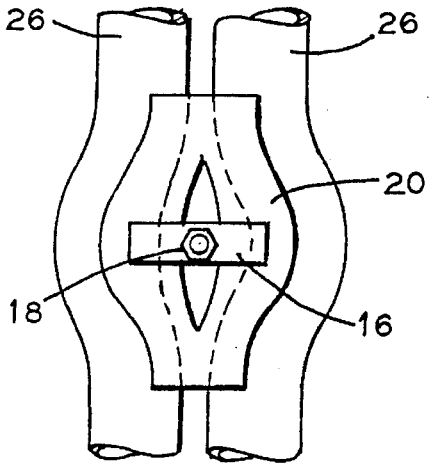
FIG. 2 is a front view that illustrates the invention in use.
Figure 3:
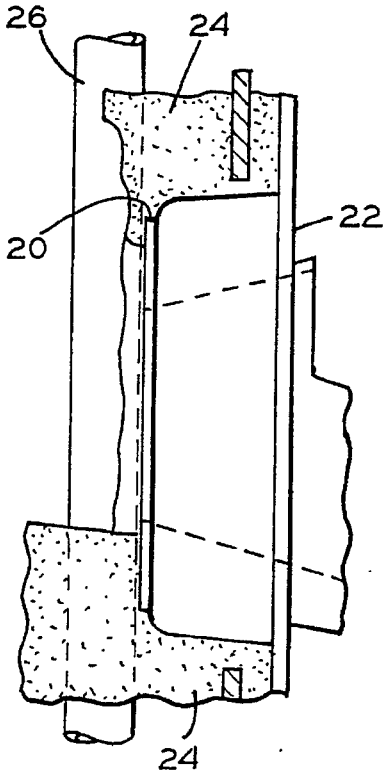
FIG. 3 is a partial side sectional view that illustrates a smelt spout and casting in position in a recovery boiler.
Figure 4:
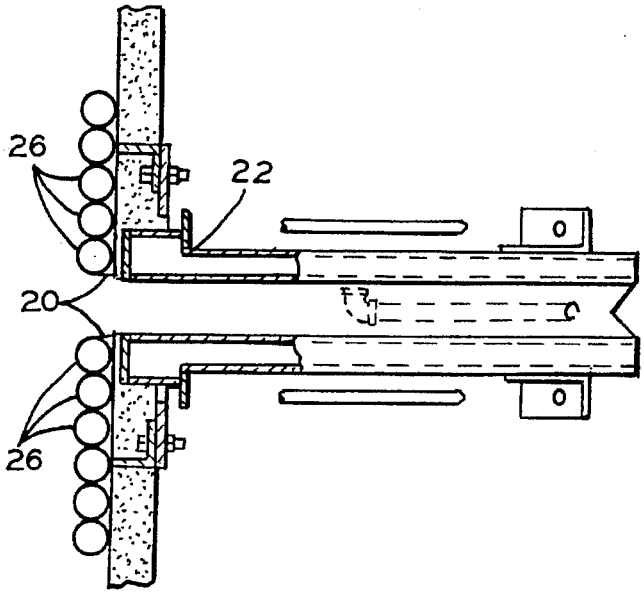
FIG. 4 is a top sectional view that illustrates a smelt spout and casting in position in a recovery boiler.

Casting installation jig 10 is used in the following manner when installing a smelt spout casting 20, seen in FIG. 1–4 in a recovery boiler. The old smelt spouts 22 and old refractory are removed. FIG. 3 and 4 illustrate a smelt spout casting 20 and smelt spout 22 installed in a recovery boiler where the invention has been used. A suitable refractory 24, such as Kao-tab SR® is troweled against the tubes 26 in the tube opening as seen in FIG. 3 and 4. First rectangular plate 14 is inserted in the opening between tubes 26 and rotated so as to be perpendicular to the longitudinal axis of tubes 26 and bear against the back side of tubes 26. Smelt spout casting 20 is positioned against tubes 26. Second rectangular plate 16 is tightened against smelt spout casting 20 and held in position by locking collar 18 as seen in FIG. 1 and 2. Installation jig 10 should be tightened to squeeze all excess refractory 24 from between casting 20 and tubes 26. Casting 20 may be tapped with a hammer to remove excess refractory 24 if necessary. Refractory 24 should be troweled between the bent tubes forming the spout opening and the next tube over to fill the void between the tubes. Refractory 24 should be smoothed into a flat surface even with casting 20 to give a level spout mounting surface. The spout mounting box and smelt spout 22 are then installed. Installation jig 10 may be loosened and removed once the spout mounting bolts are tightened since spout 22 then holds casting 20 in its installed position. Refractory 24 is then poured around smelt spout 22 from the top of the mounting box and should be rodded from the side rodding ports to insure that there are no voids at the bottom of the opening. The mounting box should be vibrated and the rodding of the refractory and vibration should be repeated as necessary.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a recovery boiler having a plurality of wall tubes where two wall tubes are each bent at an opening in the wall of the boiler wall to define an opening between the two tubes, a method for installing a smelt spout casting, spout mounting box, and smelt spout at the tube opening, comprising:

a. placing refractory material on the tubes at the tube opening;

b. inserting a rectangular plate in the opening between the tubes and rotating the rectangular plate so as to be perpendicular to the longitudinal axis of the tubes, said rectangular plate having a threaded rod attached at one end to the center of said plate;

c. placing a smelt spout casting against the tubes at the tube opening;

d. tightening a second rectangular plate received on the threaded rod against the smelt spout casting;

e. placing refractory material between the tubes forming the opening and the respective adjacent tubes;

f. installing the smelt mounting box and smelt spout in position against the smelt spout casting; and g. removing the rectangular plates and threaded rod.

* * * * *